US010844468B2

(12) United States Patent
Miyagi et al.

(10) Patent No.: US 10,844,468 B2
(45) Date of Patent: Nov. 24, 2020

(54) COPPER ALLOY SHEET MATERIAL AND CURRENT-CARRYING COMPONENT

(71) Applicant: DOWA METALTECH CO., LTD., Tokyo (JP)

(72) Inventors: Kuniaki Miyagi, Tokyo (JP); Takashi Suga, Tokyo (JP); Tomotsugu Aoyama, Tokyo (JP); Hiroto Narieda, Tokyo (JP); Hideki Endo, Tokyo (JP); Akira Sugawara, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 725 days.

(21) Appl. No.: 14/912,641

(22) PCT Filed: Aug. 26, 2014

(86) PCT No.: PCT/JP2014/072264
§ 371 (c)(1),
(2) Date: Feb. 18, 2016

(87) PCT Pub. No.: WO2015/029986
PCT Pub. Date: Mar. 5, 2015

(65) Prior Publication Data

US 2016/0201179 A1 Jul. 14, 2016

(30) Foreign Application Priority Data

Aug. 30, 2013 (JP) ..... 2013-180162

(51) Int. Cl.

| | |
|---|---|
| ***C22F 1/08*** | (2006.01) |
| ***C22C 9/00*** | (2006.01) |
| ***C22F 1/00*** | (2006.01) |
| ***C22C 9/02*** | (2006.01) |
| ***H01B 1/02*** | (2006.01) |

(52) U.S. Cl.
CPC ..... *C22F 1/08* (2013.01); *C22C 9/00* (2013.01); *C22C 9/02* (2013.01); *C22F 1/002* (2013.01); *H01B 1/026* (2013.01)

(58) Field of Classification Search
CPC ..... C22F 1/08
See application file for complete search history.

(56) References Cited

U.S. PATENT DOCUMENTS

| | | | | |
|---|---|---|---|---|
| 4,605,532 | A * | 8/1986 | Knorr | C22C 9/00 148/412 |
| 6,093,265 | A | 7/2000 | Brenneman | |
| 2013/0087255 | A1 * | 4/2013 | Kuwagaki | C22C 9/06 148/554 |

FOREIGN PATENT DOCUMENTS

| | | | | |
|---|---|---|---|---|
| EP | 2439296 | A2 * | 4/2012 | C22C 9/02 |
| JP | 61-67738 | | 4/1986 | |
| JP | 10-265873 | | 10/1998 | |
| JP | 2001-131657 | | 5/2001 | |
| JP | 2006-200036 | | 8/2006 | |
| JP | 2007-039793 | | 2/2007 | |
| JP | 2007-177274 | | 7/2007 | |
| JP | 2007-291518 | | 11/2007 | |
| JP | 2009-275286 | | 11/2009 | |
| JP | 2013007062 | A * | 1/2013 | |

OTHER PUBLICATIONS

Espacenet machine translation of JP2013007062A, generated Nov. 30, 2018 (Year: 2018).*

* cited by examiner

*Primary Examiner* — Colleen P Dunn
*Assistant Examiner* — Anthony M Liang
(74) *Attorney, Agent, or Firm* — Clark & Brody LP

(57) ABSTRACT

A copper alloy sheet material contains, in mass %, Fe: 0.05 to 2.50%, Mg: 0.03 to 1.00%, and P: 0.01 to 0.20%, and the contents of these elements satisfy the relation Mg-1.18(P—Fe/3.6)$^3$ 0.03. The Mg solid-solution ratio determined by the amount of dissolved Mg (mass %)/the Mg content of the alloy (mass %) ' 100 is 50% or more. The density of an Fe—P-based compound having a particle size of 50 nm or more is 10.00 particles/10 mm$^2$ or less, and the density of an Mg—P-based compound having a particle size of 100 nm or more is 10.00 particles/10 mm$^2$ or less. The Cu—Fe—P—Mg-based copper alloy sheet material is excellent in terms of electrical conductivity, strength, bending workability, and stress relaxation resistance in the case where load stress is applied in a direction perpendicular to both a rolling direction and a sheet thickness direction.

3 Claims, No Drawings

COPPER ALLOY SHEET MATERIAL AND CURRENT-CARRYING COMPONENT

TECHNICAL FIELD

The present invention relates to a Cu—Fe—P—Mg-based copper alloy sheet material having improved bending workability and stress relaxation resistance, particularly, a high-strength copper alloy sheet material suitable for a component to be used under stress applied in the direction (TD) perpendicular to both the rolling direction and the thickness direction, such as a tuning-fork terminal. The present invention also relates to an electric current-carrying component obtained by processing the copper alloy sheet material, such as a tuning-fork terminal.

BACKGROUND ART

A Cu—Fe—P—Mg-based copper alloy is an alloy which enables a high-strength member having excellent electrical conductivity, and has been used for electric current-carrying components. Using this type of copper alloy, attempts have been made to improve strength, electrical conductivity, pressing workability, bending workability, stress relaxation resistance, and like properties according to the purpose (Patent Documents 1 to 5).

PRIOR ART DOCUMENTS

Patent Documents

Patent Document 1: JP-A-61-67738
Patent Document 2: JP-A-10-265873
Patent Document 3: JP-A-2006-200036
Patent Document 4: JP-A-2007-291518
Patent Document 5: U.S. Pat. No. 6,093,265

SUMMARY OF THE INVENTION

Problems that the Invention is to Solve

As a copper alloy sheet material to be used for an electric current-carrying component, such as a connector, it is important to have excellent bending workability and excellent stress relaxation resistance. Among them, stress relaxation resistance is conventionally evaluated by a method in which load stress (deflection displacement) is applied in the thickness direction of a sheet material being a workpiece sheet. However, in the case of a tuning-fork terminal or like component, the component is used with displacement being imparted in the direction perpendicular to the thickness direction of the workpiece, that is, the direction parallel to the sheet surface of the workpiece. With respect to a sheet material, the rolling direction (LD) and the direction (TD) perpendicular to both the rolling direction and the thickness direction are both "direction perpendicular to the thickness direction". In the case of a tuning-fork terminal, regardless of the direction of taking the component from a sheet material being a workpiece sheet, the resulting component has a part where the direction of deflection displacement being imparted is LD and a part where it is TD.

According to a study by the inventors, as a result of the comparison of the stress relaxation resistances of the same copper alloy sheet material in the three cases where the direction of deflection displacement being imparted (the direction of the load stress) is the thickness direction (i), LD (ii), or TD (iii), it has been found that the stress relaxation ratio is likely to be the worst in the case of (iii) where the direction is TD. Therefore, considering the application to a component to be used with displacement being imparted in the "direction perpendicular to the thickness direction", such as a tuning-fork terminal, it is important to improve stress relaxation resistance in the case where the direction of deflection displacement is TD. However, a copper alloy sheet material improved in such characteristics is heretofore unknown.

An object of the present invention is, with respect to a high-strength Cu—Fe—P—Mg-based copper alloy sheet material having excellent electrical conductivity, to particularly improve bending workability and stress relaxation resistance in the case where the direction of deflection displacement is TD at the same time.

Means for Solving the Problems

According to a detailed study by the inventors, it has been found that in a Cu—Fe—P—Mg-based copper alloy sheet material, Mg dissolved in the matrix and a fine Fe—P-based compound function extremely effectively in improving stress relaxation resistance in the case where the direction of deflection displacement is TD. It has also been turned out that an Mg—P-based compound having a particle size of 100 nm or more is a factor of causing a decrease in bending workability. Further, it has been found that in order to inhibit the production of an Mg—P-based compound having a particle size of 100 nm or more and also ensure a sufficient amount of dissolved Mg, it is effective to preferentially produce a fine Fe—P-based compound in a high-temperature region of 600 to 850° C. to reduce P that binds to Mg, and then further finely precipitate an Fe—P-based compound and an Mg—P-based compound in a low-temperature region of 400 to 590° C. Further, with respect to Mg, the obtained data show that when 50% or more Mg of the total Mg content is contained as dissolved Mg, it is extremely effective in improving bending workability and stress relaxation resistance in the case where the direction of deflection displacement is TD. The present invention has been accomplished based on these findings.

That is, the above object is achieved by a copper alloy sheet material containing, in mass %, Fe: 0.05 to 2.50%, Mg: 0.03 to 1.00%, P: 0.01 to 0.20%, Sn: 0 to 0.50%, Ni: 0 to 0.30%, Zn: 0 to 0.30%, Si: 0 to 0.10%, Co: 0 to 0.10%, Cr: 0 to 0.10%, B: 0 to 0.10%, Zr: 0 to 0.10%, Ti: 0 to 0.10%, Mn: 0 to 0.10%, and V: 0 to 0.10%, the balance being Cu and inevitable impurities, and having a chemical composition that satisfies the following equation (1), the copper alloy sheet material being such that when the average Mg concentration (mass %) in a Cu matrix part determined by EDX analysis through TEM observation at a magnification of 100,000 is defined as the amount of dissolved Mg, the Mg solid-solution ratio defined by the following equation (2) is 50% or more, the density of an Fe—P-based compound having a particle size of 50 nm or more is 10.00 particles/10 $\mu m^2$ or less, and the density of an Mg—P-based compound having a particle size of 100 nm or more is 10.00 particles/10 $\mu m^2$ or less:

$$Mg-1.18(P—Fe/3.6)\geq 0.03 \quad (1)$$

$$\text{Mg solid-solution ratio (\%)} = \text{the amount of dissolved Mg (mass \%)/the total Mg content (mass \%)} \times 100 \quad (2),$$

wherein the element symbols Mg, P, and Fe in the equation (1) are substituted with the contents of the respective elements in mass %.

The particle size of an Fe—P-based compound and an Mg—P-based compound refers to the maximum dimension of a particle observed by TEM.

The above copper alloy sheet material has the following properties, for example:

an electrical conductivity of 65% IACS or more;

when the rolling direction is defined as LD, and the direction perpendicular to both the rolling direction and the thickness direction is defined as TD, a 0.2% offset yield strength in LD of 450 N/mm$^2$ or more in accordance with JIS Z2241;

bending workability such that no cracking is observed in a W bending test in accordance with JIS Z3110 under conditions where the bending axis is LD and the ratio R/t between the bending radius R and the thickness t is 0.5; and a stress relaxation ratio of 35% or less in the case where, in a cantilever stress relaxation test using a specimen whose longitudinal direction agrees with LD and width in TD is 0.5 mm, a load stress of 80% of the 0.2% offset yield strength in LD is applied to the specimen in such a manner that the direction of deflection displacement to be imparted is TD, followed by holding at 150° C. for 1,000 hours. It is preferable that the copper alloy sheet material of the present invention has a thickness within a range of 0.1 to 2.0 mm, still more preferably within a range of 0.4 to 1.5 mm.

As a method for producing the above copper alloy sheet material, provided is a method including:

a casting step of solidifying a melt of a copper alloy of the above chemical composition in a mold, followed by a cooling process such that the average cooling rate from 700 to 300° C. is 30° C./min or more to produce a slab;

a slab-heating step of heating and holding the obtained slab at a range of 850 to 950° C.;

a hot rolling step of hot rolling the heated slab at a final pass temperature of 400 to 700° C., followed by rapid cooling such that the average cooling rate from 400 to 300° C. is 5° C./sec or more to produce a hot-rolled sheet;

a cold rolling step of rolling the hot-rolled sheet to a rolling ratio of 30% or more;

a first intermediate annealing step of raising the temperature to a holding temperature T° C. within a range of 600 to 850° C. such that the average temperature rise rate from 300° C. to T° C. is 5° C./sec or more, and holding the sheet at 1° C. for 5 to 300 sec, followed by cooling such that the average cooling rate from T° C. to 300° C. is 5° C./sec or more;

a second intermediate annealing step of holding the sheet at a range of 400 to 600° C. for 0.5 h or more, followed by cooling such that the average cooling rate from the holding temperature to 300° C. is 20 to 200° C./h;

a finish cold rolling step of rolling the sheet to a rolling ratio of 5 to 95%; and a low-temperature annealing step of heating the sheet at 200 to 400° C.

The present invention also provides a component obtained by processing the above copper alloy sheet material, which is an electric current-carrying component for use under load stress applied in a direction in the component derived from the direction (ID) perpendicular to both the rolling direction and the thickness direction of the copper alloy sheet material.

Advantage of the Invention

According to the present invention, a copper alloy sheet material having high levels of electrical conductivity, strength, bending workability, and stress relaxation resistance is provided. In particular, in an electric current-carrying component to be used under load stress applied in the direction (TD) perpendicular to both the rolling direction and the thickness direction, high durability can be achieved.

MODE FOR CARRYING OUT THE INVENTION

<<Chemical Composition>>

Hereinafter, "%" regarding the chemical composition of an alloy element means "mass %" unless otherwise noted.

Fe is an element that forms a compound with P and finely precipitates in the matrix, thereby contributing to the improvement of strength and also the improvement of stress relaxation resistance. In order for these effects to be sufficiently exerted, an Fe content of 0.05% or more should be ensured. However, the presence of excessive Fe causes a decrease in electrical conductivity, and thus the content is limited within a range of 2.50% or less. The content is more preferably 1.00% or less, and still more preferably 0.50% or less.

P generally contributes as a deoxidizer for a copper alloy. However, in the present invention, P serves to improve strength and stress relaxation resistance through the fine precipitation of an Fe—P-based compound and an Mg—P-based compound. In order for these effects to be sufficiently exerted, a P content of 0.01% or more should be ensured. The content is more preferably 0.02% or more. However, an increase in the P content is likely to cause hot tearing, and thus the P content should be within a range of 0.20% or less. The content is more preferably 0.17% or less, and still more preferably 0.15% or less.

Mg dissolves in the Cu matrix, thereby contributing to the improvement of stress relaxation resistance. In addition, it forms a fine Mg—P-based compound, thereby contributing to the improvement of strength and stress relaxation resistance. In particular, with respect to stress relaxation resistance in the case where the direction of deflection displacement being imparted is TD (hereinafter referred to as "stress relaxation resistance with deflection direction TD"), in addition to the contribution of a fine Fe—P-based compound, the contribution of dissolved Mg and the contribution of a fine Mg—P-based compound are necessary. For this purpose, it is necessary that the Mg content is 0.03% or more. However, the addition of a large amount of Mg may cause trouble, such as hot tearing. As a result of various studies, the Mg content is limited to 1.00% or less. The content is more preferably 0.50% or less, and still more preferably 0.20% or less.

Further, in the relation with the contents of Fe and P, Mg is contained to satisfy the following equation (1).

$$Mg-1.18(P—Fe/3.6)\geq 0.03 \ldots \quad (1)$$

Here, the element symbols Mg, P, and Fe in equation (1) are substituted with the contents of the respective elements in mass %. The Mg content is the same as the total Mg content in the below equation (2). The left side of equation (1) is an index of the amount of free Mg (mass %) that does not form a compound. In the present invention, it is necessary that the Mg content is at least ensured for the amount of free Mg represented by this index to be 0.03% or more. Theoretically, it is believed that the amount of free Mg calculated by the left side of equation (1) corresponds to the amount of dissolved Mg in the Cu matrix. However, as mentioned below, it has been found that the amount of dissolved Mg actually measured is often lower than the above theoretical amount of free Mg. Therefore, in the present invention, it is required to ensure the actual amount of dissolved Mg as in the below equation (2).

In addition, one or more of the following elements can be contained as necessary within each content range.

Sn: 0.50% or less, Ni: 0.30% or less, Zn: 0.30% or less, Si: 0.10% or less, Co: 0.10% or less, Cr: 0.10% or less, B: 0.10% or less, Zr: 0.10% or less, Ti: 0.10% or less, Mn: 0.10% or less, V: 0.10% or less However, it is preferable that the total content of these optional elements is 0.50% or less.

<<Mg Solid-Solution Ratio>>

In the present invention, in order to improve stress relaxation resistance, the function of Mg dissolved in the Cu matrix is utilized. The atomic radius of Mg is larger than that of Cu. Therefore, Mg forms a Cottrell atmosphere or binds to holes to reduce the holes in the matrix, and these functions are believed to inhibit the dislocation movement, thereby improving stress relaxation resistance.

As mentioned above, the amount of dissolved Mg in the Cu matrix can be estimated to some extent by the calculation of the left side of equation (1) based on the chemical composition. However, as a result of the detailed microscopic EDX analysis (energy dispersive X-ray analysis) by the inventors using TEM (transmission electron microscope), it has been confirmed that the amount of Mg that appears to be actually dissolved in the matrix is not necessarily near the value estimated from equation (1), and may sometimes be a significantly lower value. In particular, it has been found that in order to stably improve stress relaxation resistance with deflection direction TD, it is extremely effective to sufficiently ensure "the amount of actually dissolved Mg", which is determined based on direct measurement.

The amount of actually dissolved Mg can be evaluated by a technique that measures the amount of Mg in the Cu matrix part detected by EDX analysis through TEM observation. Specifically, in a TEM observation image at a magnification of 100,000 the Cu matrix part where no precipitate is seen is irradiated with an electron beam and subjected to EDX analysis to measure the Mg concentration. The measurement is performed at randomly selected ten points, and the average of the Mg concentration values (in mass %) measured at all points is defined as the amount of dissolved Mg of the copper alloy sheet material.

According to a study by the inventors, it has been found that as a condition required to stably improve stress relaxation resistance with deflection direction TD, it is important that 50% or more of the total Mg contained in the alloy is present as the amount of dissolved Mg (i.e., the amount of dissolved Mg based on actual measurement). Specifically, in order to stably achieve excellent stress relaxation resistance such that the stress relaxation is 35% or less in the below stress relaxation test, in which the direction of deflection displacement being imparted is TD, the Mg solid-solution ratio defined by the following equation (2) is specified to be 50% or more.

$$\text{Mg solid-solution ratio (\%)} = \text{the amount of dissolved Mg (mass \%)} / \text{the total Mg content (mass \%)} \times 100 \ldots \quad (2)$$

Here, "the amount of dissolved Mg (mass %)" is the amount of dissolved Mg based on the actual measurement mentioned above, while "the total Mg content (mass %)" is the Mg content (mass %) shown as the chemical composition of the copper alloy sheet material. It is not necessary to particularly specify the upper limit of the Mg solid-solution ratio. It may be near 100%, but is usually 95% or less. Incidentally, in order to stably improve stress relaxation resistance with deflection direction TD, just to make the Mg solid-solution ratio 50% or more is insufficient, and it is necessary that the metal structure has fine particles of an Fe—P compound dispersed in the Cu matrix.

<<Metal Structure>>

[Fe—P-based Compound]

An Fe—P-based compound contains Fe in the highest atomic proportion and P in the second highest proportion, and is based on $Fe_2P$. Fine particles of an Fe—P-based compound having a particle size of less than 50 nm contribute to the improvement of strength and the improvement of stress relaxation resistance through distribution in the Cu matrix. However, coarse particles having a particle size of 50 nm or more do not contribute much to the improvement of strength and the improvement of stress relaxation resistance. In addition, further coarsening of particles causes a decrease in bending workability.

Whether the fine Fe—P-based compound, which is effective in improving strength and stress relaxation resistance, is sufficiently present can be evaluated based on whether the amount of coarse Fe—P-based compound and the amount of coarse Mg—P-based compound are suppressed within predetermined ranges. Specifically, in a copper alloy that satisfies the chemical composition specified in the present invention, in the case where the density of an Fe—P-based compound having a particle size of 50 nm or more is suppressed to 10.00 particles/10 $\mu m^2$ or less, and the density of an Mg—P-based compound having a particle size of 100 nm or more is suppressed to 10.00 particles/10 $\mu m^2$ or less, it can be understood that fine Fe—P-based compound particles are dispersed in an amount sufficient to achieve excellent stress relaxation resistance in TD. It is more effective that the density of an Fe—P-based compound having a particle size of 50 nm or more is suppressed to 5.00 particles/10 $\mu m^2$ or less.

Incidentally, the excessive reduction of the density of an Fe—P-based compound having a particle size of 50 nm or more imposes increased restrictions on the production conditions and thus is undesirable. The density of an Fe—P-based compound having a particle size of 50 nm or more is usually within a range of 0.05 to 10.00 particles/10 $\mu m^2$, and may also be controlled within a range of 0.05 to 5.00 particles/10 $\mu m^2$.

[Mg—P-based Compound]

An Mg—P-based compound contains Mg in the highest atomic proportion and P in the second highest proportion, and is based on $Mg_3P_2$. Fine particles of an Mg—P-based compound having a particle size of less than 100 nm contribute to the improvement of strength and the improvement of stress relaxation resistance through distribution in the Cu matrix. However, for stress relaxation resistance, the presence of dissolved Mg is effective, but the presence of a large amount of Mg—P-based compound having a particle size of less than 100 nm may cause a decrease in the amount of dissolved Mg. Thus, in the present invention, the presence of a large amount of fine Mg—P-based compound is not necessarily preferable. Meanwhile, it has been found that in addition to not contributing much to the improvement of strength and the improvement of stress relaxation resistance, an Mg—P-based compound particle having a particle size of 100 nm or more also serves as a major factor that reduces bending workability. As a result of various studies, it is necessary that the density of an Mg—P-based compound having a particle size of 100 nm or more is limited to 10.00 particles/10 $\mu m^2$ or less, more preferably 5.00 particles/10 $\mu m^2$ or less.

Incidentally, the excessive reduction of the density of an Mg—P-based compound having a particle size of 100 nm or more imposes increased restrictions on the production conditions and thus is undesirable. The density of an Mg—P-based compound having a particle size of 100 nm or more is usually within a range of 0.05 to 10.00 particles/10 $\mu m^2$, and may also be controlled within a range of 0.05 to 5.00 particles/10 $\mu m^2$.

<<Properties>>

In a copper alloy sheet material having the above chemical composition, Mg solid-solution ratio, and metal structure, one having the following properties can be provided:

(a) an electrical conductivity of 65% IACS or more, preferably 70% IACS or more;

(b) when the rolling direction is defined as LD, and the direction perpendicular to both the rolling direction and the thickness direction is defined as TD, a 0.2% offset yield strength in LD of 450 N/$mm^2$ or more in accordance with JIS Z2241;

(c) bending workability such that no cracking is observed in a 90° W bending test in accordance with JIS Z3110 under conditions where the bending axis is LD (B.W.) and the ratio R/t between the bending radius R and the thickness t is 0.5; and (d) a stress relaxation of 35% or less, preferably 30% or less, in the case where, in a cantilever stress relaxation test using a specimen whose longitudinal direction agrees with LD and width in TD is 0.5 mm, a load stress of 80% of the 0.2% offset yield strength in LD is applied to the specimen in such a manner that the direction of deflection displacement being imparted is TD, followed by holding at 150° C. for 1,000 hours.

A copper alloy sheet material having such properties is particularly suitable for an electric current-carrying member to which deflection displacement is imparted in the direction parallel to the sheet surface of the workpiece, such as a tuning-fork terminal.

Incidentally, the stress relaxation test mentioned above may be performed by the cantilever method described in the Standard of Electronic Materials Manufacturers Association of Japan, EMAS-1011, in such a manner that the direction of deflection displacement being imparted is TD.

<<Production Method>>

A copper alloy sheet material that meets the above requirements about Mg solid-solution ratio, an Fe—P-based compound, and an Mg—P-based compound and has the above properties can be obtained by the following method, for example.

[Casting Step]

A melt of a copper alloy of the chemical composition as specified above is solidified in a mold (casting mold), followed by a cooling process such that the average cooling rate from 700 to 300° C. is 30° C./min or more to produce a slab. This average cooling rate is based on the surface temperature of the slab. In a temperature region of 700 to 300° C., an Fe—P-based compound and an Mg—P-based compound are produced. When cooling in this temperature region is performed at a cooling rate lower than the above rate, large amounts of extremely coarse Fe—P-based compound and Mg—P-based compound are produced. In that case, it is extremely difficult to obtain a sheet material in which a fine Fe—P-based compound is dispersed, and also the Mg solid-solution ratio is within the range mentioned above. As the casting method, either of batch casting and continuous casting may be employed. After casting, the surface of the slab is faced as necessary.

[Slab-Heating Step]

The slab obtained in the casting step is heated and held at a range of 850 to 950° C. It is preferable that the holding time at this temperature range is 0.5 h or more. As a result of this holding, the homogenization of the cast structure proceeds, and also the dissolution of a coarse Fe—P-based compound and a coarse Mg—P-based compound proceeds. This heat treatment can be performed at the time of slab heating in the hot rolling step.

[Hot Rolling Step]

The heated slab is hot-rolled at a final pass temperature of 400 to 700° C. This final pass temperature range is a temperature region where an Fe—P-based compound precipitates. An Fe—P-based compound is precipitated while applying strain under the roll pressure during hot rolling, whereby the Fe—P-based compound is finely precipitated. It is preferable that the total hot rolling ratio is about 70 to about 98%. After the final pass of hot rolling, the slab is rapidly cooled such that the average cooling rate from 400 to 300° C. is 5° C./sec or more to produce a hot-rolled sheet. This temperature range of rapid cooling is a temperature region where an Mg—P-based compound precipitates. Cooling in this temperature region is rapidly performed so as to inhibit the production of an Mg—P-based compound as much as possible.

[Cold Rolling Step]

The hot-rolled sheet is cold-rolled to a rolling ratio of 30% or more, more preferably 35% or more. Because of the cold working strain imparted in this step, the Fe—P-based compound precipitation treatment can be completed within an extremely short period of time by annealing in the next step, which is effective in the size reduction of the Fe—P-based compound. The upper limit of the cold rolling ratio can be suitably set according to the desired thickness and the mill power of the cold rolling mill. The rolling ratio is usually 95% or less, and it may also be set within a range of 70% or less.

[First Intermediate Annealing Step]

The copper alloy sheet material according to the present invention can be suitably produced through two stages of intermediate annealing. First, in the first intermediate annealing of the first stage, a fine Fe—P-based compound is preferentially precipitated by a high-temperature, short-time heat treatment. Specifically, the temperature is raised to a holding temperature T° C. within a range of 600 to 850° C. such that the average temperature rise rate from 300° C. to T° C. is 5° C./sec or more, and then the sheet material is held at T° C. for 5 to 300 sec, followed by cooling such that the average cooling rate from T° C. to 300° C. is 5° C./sec or more.

When the above average temperature rise rate is too low, an Mg—P-based compound is produced during the temperature-rising process, making it impossible to achieve the preferential precipitation of an Fe—P-based compound. As a result, the final structure has a coarsened Mg—P-based compound or has a low Mg solid-solution ratio, resulting in insufficient improvement in bending workability or stress relaxation resistance. At a range of 600 to 850° C., an Fe—P-based compound precipitates, but almost no Mg—P-based compound precipitates. When the holding time in this temperature region is as short as 5 sec to 5 min, the precipitated Fe—P-based compound is prevented from coarsening. When the holding temperature is less than 600° C., the precipitation of an Fe—P-based compound takes time and, in some cases, may be accompanied by the precipitation of an Mg—P-based compound. When the temperature is raised to a temperature of more than 850° C., the Fe—P-based compound redissolves, making it difficult to ensure the sufficient production of a fine Fe—P-based compound. When the above average cooling rate is too low, the coarsening of the preferentially precipitated Fe—P-based compound is likely to take place.

[Second Intermediate Annealing Step]

Next, in the second intermediate annealing of the second stage, a heat treatment is performed in a relatively low temperature region fora relatively long period of time so that recrystallization sufficiently proceeds. Specifically, the sheet material is held at a range of 400 to 590° C. for 0.5 h or more, followed by cooling such that the average cooling rate from the holding temperature to 300° C. is 20 to 200° C./h. Cooling may be performed by allowing to cool outside the furnace, and no special rapid cooling is required. The upper limit of the holding time is not particularly specified. It is usually 5 h or less, and may also be set at 3 h or less.

The temperature range of 400 to 590° C. is a temperature region where an Fe—P-based compound and an Mg—P-based compound are produced. However, because an Fe—P-based compound has been preferentially produced by the first intermediate annealing, and much of P has been consumed as the Fe-P-based compound, the production of an Mg—P-based compound is inhibited in the second intermediate annealing. In addition, because the temperature is relatively low, the growth of the already produced fine Fe—P-based compound is inhibited, and the growth of an Fe—P-based compound newly produced in this stage is also inhibited maintaining its fine particle size. As a result, a structure having a large amount of fine Fe—P-based compound and a small amount of Mg—P-based compound, with the amounts of coarse Fe—P-based compound and Mg—P-based compound being small, is obtained. Because the amount of Mg—P-based compound is small, the Mg solid-solution ratio is accordingly high.

When the holding temperature is less than 400° C., the Mg—P-based compound production becomes dominant over the Fe—P-based compound production, and this is likely to result in a structure having a large amount of coarse Mg—P-based compound with a low Mg solid-solution ratio. In addition, when holding is performed at a temperature of more than 590° C. for 0.5 h or more, the coarsening of the already produced Fe—P-based compound is likely to take place.

When the cooling rate after heating and holding is too high, the sufficient production of fine precipitates cannot be ensured. Therefore, it is preferable that the cooling rate at least to 300° C. is 200° C./h or less, more preferably 150° C./h or less. However, an excessively low cooling rate causes a decrease in productivity. Therefore, it should be 20° C./h or more, preferably 50° C./h or more.

[Finish Cold Rolling Step]

After the two stages of intermediate annealing mentioned above, for the final adjustment of the thickness or the further improvement of strength, finish cold rolling is performed to provide a rolling ratio falling within the range of 5 to 95%. When the rolling ratio is excessively high, the amount of strain in the material increases, resulting in a decrease in bending workability. Therefore, it is preferable that the rolling ratio is 95% or less, more preferably 70% or less. However, in order to sufficiently obtain the strength-improving effect, it is preferable to ensure a rolling ratio of 5% or more, and it is more preferable to ensure a rolling ratio of 20% or more.

[Low-Temperature Annealing Step]

Low-temperature annealing is generally performed in a continuous annealing furnace or a batch annealing furnace. In any case, the material is heated and held so that the temperature thereof is 200 to 400° C. As a result, strain is relaxed, and electrical conductivity is improved. In addition, bending workability and stress relaxation resistance are also improved. In the case where the heating temperature is less than 200° C., the strain-relaxing effect is not sufficiently obtained. Particularly in the case where the rolling ratio in finish cold rolling is high, it is difficult to improve bending workability. When the heating temperature is more than 400° C., the material is likely to be softened, and this is thus undesirable. The holding time may be 3 to 120 sec in the case of continuous annealing, and 10 min to 24 h is the case of batch annealing, approximately.

EXAMPLES

A copper alloy having the chemical composition shown in Table 1 was melted to obtain a slab. At the time of casting, the cooling rate on the slab surface was monitored with a thermocouple installed in the mold (casting mold). A slab of 40 mm×40 mm×20 mm was cut out from the slab (ingot) after casting and subjected to the slab-heating step and the following steps. The production conditions are shown in Table 2. In the hot rolling step, the slab was hot-rolled to a thickness of 5 mm. The rolling ratios in the cold rolling step and the finish cold rolling step were set as shown in Table 2 to give a final thickness of 0.64 mm in all the examples. Incidentally, the slab-heating step was performed utilizing the slab heating at the time of hot rolling.

In Table 2, in the First Intermediate Annealing, "average temperature rise rate" means the average temperature rise rate from 300° C. to the holding temperature, "holding time" means the time after the holding temperature is reached until cooling is started, and "average cooling rate" means the average cooling rate from the holding temperature to 300° C. In the examples given "Water cooling" in the space for average cooling rate, a sheet material after the heat treatment was cooled by immersion in water, and the average cooling rate to 300° C. was more than 10° C./sec. In addition, in the Second Intermediate Annealing, "average cooling rate" means the average cooling rate from the holding temperature to 300° C.

TABLE 1

| | Chemical Composition (mass %) | | | | | | | | |
|---|---|---|---|---|---|---|---|---|---|
| Example No. | Cu | Fe | Mg | P | Sn | Ni | Zn | Others | Mg − 1.18 × (P − Fe/3.6) |
| Example 1 | Balance | 0.21 | 0.14 | 0.06 | — | — | — | — | 0.14 |
| Example 2 | Balance | 0.05 | 0.18 | 0.05 | — | — | — | — | 0.14 |
| Example 3 | Balance | 2.10 | 0.04 | 0.06 | — | — | 0.16 | Si: 0.03, B: 0.005 | 0.66 |
| Example 4 | Balance | 0.07 | 0.82 | 0.19 | — | — | — | Si: 0.04, V: 0.02 | 0.62 |
| Example 5 | Balance | 0.20 | 0.03 | 0.05 | 0.07 | 0.08 | — | Co: 0.05, Mn: 0.01 | 0.04 |
| Example 6 | Balance | 0.15 | 0.18 | 0.05 | — | — | — | Ti: 0.07, Cr: 0.07, B: 0.03 | 0.17 |
| Example 7 | Balance | 0.05 | 0.16 | 0.03 | 0.19 | — | — | Zr: 0.02 | 0.14 |

TABLE 1-continued

| Example No. | Chemical Composition (mass %) | | | | | | | | Mg − 1.18 × (P − Fe/3.6) |
|---|---|---|---|---|---|---|---|---|---|
| | Cu | Fe | Mg | P | Sn | Ni | Zn | Others | |
| Comparative Example 1 | Balance | 0.21 | 0.14 | 0.06 | — | — | — | — | 0.14 |
| Comparative Example 2 | Balance | 0.21 | 0.14 | 0.06 | — | — | — | — | 0.14 |
| Comparative Example 3 | Balance | 0.21 | 0.14 | 0.06 | — | — | — | — | 0.14 |
| Comparative Example 4 | Balance | 0.21 | 0.14 | 0.06 | — | — | — | — | 0.14 |
| Comparative Example 5 | Balance | 0.21 | 0.14 | 0.06 | — | — | — | — | 0.14 |
| Comparative Example 6 | Balance | 0.21 | 0.14 | 0.06 | — | — | — | — | 0.14 |
| Comparative Example 7 | Balance | 0.21 | 0.14 | 0.06 | — | — | — | — | 0.14 |
| Comparative Example 8 | Balance | 0.21 | 0.14 | 0.06 | — | — | — | — | 0.14 |
| Comparative Example 9 | Balance | 0.04 | 0.14 | 0.005 | — | — | 0.04 | Co: 0.01, V: 0.01 | 0.15 |
| Comparative Example 10 | Balance | 2.70 | 0.04 | 0.08 | — | — | — | B: 0.003 | 0.83 |
| Comparative Example 11 | Balance | 0.21 | 0.02 | 0.06 | — | — | — | Co: 0.006, Zr: 0.01 | 0.02 |
| Comparative Example 12 | Balance | 0.21 | 1.10 | 0.23 | — | — | — | — | 0.90 |
| Comparative Example 13 | Balance | 0.21 | 0.14 | 0.06 | 0.70 | — | — | Ti: 0.03, Si: 0.005 | 0.14 |
| Comparative Example 14 | Balance | 0.21 | 0.13 | 0.07 | — | 0.35 | — | Mn: 0.01, Cr: 0.008 | 0.12 |
| Comparative Example 15 | Balance | 0.21 | 0.15 | 0.06 | — | — | 0.40 | V: 0.02 | 0.15 |

Underline: Outside the specified range according to the present invention

TABLE 2

| Example No. | Casting | | | Hot Rolling | | | First Intermediate Annealing | |
|---|---|---|---|---|---|---|---|---|
| | 700-300° C. | Slab Heating | | 400-300° C. | | | Average | |
| | Average Cooling Rate (° C./min) | Holding Temp. (° C.) | Holding Time (h) | Final Pass Temp. (° C.) | Average Cooling Rate (° C./sec) | Cold Rolling Rolling Ratio (%) | Temp. Rise Rate (° C./sec) | Holding Temp. (° C.) |
| Example 1 | 50 | 900 | 0.5 | 600 | 30 | 60 | 10 | 700 |
| Example 2 | 50 | 950 | 0.5 | 420 | 30 | 60 | 6 | 605 |
| Example 3 | 50 | 900 | 0.5 | 450 | 30 | 60 | 10 | 700 |
| Example 4 | 50 | 900 | 0.5 | 680 | 30 | 80 | 10 | 825 |
| Example 5 | 50 | 850 | 0.5 | 450 | 7 | 60 | 10 | 700 |
| Example 6 | 35 | 900 | 0.5 | 600 | 30 | 60 | 10 | 700 |
| Example 7 | 50 | 900 | 0.5 | 600 | 30 | 40 | 10 | 700 |
| Comparative Example 1 | 50 | 900 | 0.5 | 360 | 3 | 60 | 10 | 700 |
| Comparative Example 2 | 50 | 900 | 0.5 | 750 | 30 | 60 | 10 | 700 |
| Comparative Example 3 | 50 | 900 | 0.5 | 600 | 30 | 60 | (Not performed) | |
| Comparative Example 4 | 50 | 900 | 0.5 | 600 | 30 | 60 | 3 | 575 |
| Comparative Example 5 | 50 | 900 | 0.5 | 600 | 30 | 60 | 10 | 700 |
| Comparative Example 6 | 20 | 800 | 0.5 | 600 | 30 | 60 | 10 | 700 |
| Comparative Example 7 | 50 | 900 | 0.5 | 600 | 30 | 20 | 10 | 700 |
| Comparative Example 8 | 50 | 900 | 0.5 | 600 | 30 | 60 | 10 | 700 |
| Comparative Example 9 | 50 | 950 | 0.5 | 600 | 30 | 60 | 10 | 700 |
| Comparative Example 10 | 50 | 900 | 0.5 | 600 | 30 | 60 | 10 | 700 |
| Comparative Example 11 | 50 | 900 | 0.5 | 600 | 30 | 60 | 10 | 700 |
| Comparative Example 12 | 50 | 900 | 0.5 | (cracking) | — | — | — | — |
| Comparative Example 13 | 50 | 900 | 0.5 | 600 | 30 | 60 | 10 | 700 |
| Comparative Example 14 | 50 | 900 | 0.5 | 600 | 30 | 60 | 10 | 700 |
| Comparative Example 15 | 50 | 900 | 0.5 | 600 | 30 | 60 | 10 | 700 |

| Example No. | First Intermediate Annealing | | Second Intermediate Annealing | | | Finish Cold Rolling | Low-Temperature Annealing | |
|---|---|---|---|---|---|---|---|---|
| | Holding Time (sec) | Average Cooling Rate (° C./sec) | Holding Temp. (° C.) | Holding Time (h) | Average Cooling Rate (° C./h) | Rolling Ratio (%) | Holding Temp. (° C.) | Holding Time (min) |
| Example 1 | 30 | Water cooling | 500 | 1 | 90 | 68 | 250 | 30 |
| Example 2 | 270 | Water cooling | 500 | 1 | 90 | 68 | 250 | 30 |
| Example 3 | 20 | Water cooling | 500 | 1 | 25 | 68 | 250 | 30 |
| Example 4 | 5 | 10 | 425 | 2 | 150 | 36 | 250 | 30 |
| Example 5 | 30 | 6 | 590 | 0.5 | 90 | 68 | 250 | 30 |
| Example 6 | 60 | Water cooling | 550 | 1 | 90 | 68 | 250 | 30 |
| Example 7 | 30 | Water cooling | 500 | 1 | 90 | 79 | 250 | 30 |
| Comparative Example 1 | 30 | Water cooling | 500 | 1 | 90 | 68 | 250 | 30 |
| Comparative Example 2 | 30 | Water cooling | 500 | 1 | 90 | 68 | 250 | 30 |
| Comparative Example 3 | (Not performed) | | 550 | 2 | 90 | 68 | 250 | 30 |
| Comparative Example 4 | 30 | Water cooling | 500 | 1 | 90 | 68 | 250 | 30 |
| Comparative Example 5 | 600 | 4 | 500 | 1 | 90 | 68 | 250 | 30 |
| Comparative Example 6 | 60 | Water cooling | 500 | 1 | 90 | 68 | 250 | 30 |

TABLE 2-continued

| | | | | | | | | |
|---|---|---|---|---|---|---|---|---|
| Comparative Example 7 | 60 | Water cooling | 650 | 1 | 90 | 84 | 250 | 30 |
| Comparative Example 8 | 60 | Water cooling | 350 | 2 | 90 | 68 | 250 | 30 |
| Comparative Example 9 | 30 | Water cooling | 500 | 1 | 90 | 68 | 250 | 30 |
| Comparative Example 10 | 30 | Water cooling | 500 | 1 | 90 | 68 | 250 | 30 |
| Comparative Example 11 | 30 | Water cooling | 500 | 1 | 90 | 68 | 250 | 30 |
| Comparative Example 12 | — | — | — | — | — | — | — | — |
| Comparative Example 13 | 30 | Water cooling | 500 | 1 | 90 | 68 | 250 | 30 |
| Comparative Example 14 | 30 | Water cooling | 500 | 1 | 90 | 68 | 250 | 30 |
| Comparative Example 15 | 30 | Water cooling | 500 | 1 | 90 | 68 | 250 | 30 |

Underline: Outside the specified range according to the present invention

A specimen was taken from the sheet material having a thickness of 0.64 mm obtained after the low-temperature annealing (test specimen), and the density of precipitates, Mg solid-solution ratio, electrical conductivity, 0.2% offset yield strength, bending workability, and stress relaxation ratio were examined by the following methods.

The density of precipitates was determined as follows. A sample taken from the test specimen was observed by TEM at a magnification of 40,000. In randomly selected five fields, with respect to an Fe—P-based compound having a particle size of 50 nm or more and an Mg—P-based compound having a particle size of 100 nm or more, the number of particles present in the observation area of 3.4 $\mu m^2$ was counted. The particle size is the maximum dimension of a particle observed. With respect to particles on the boundary line of the observation area, when half or more of the particle area was within the area, such particles were subjected to counting. Whether the particles were an Fe—P-based compound or an Mg—P-based compound was identified by EDX analysis. With respect to particles of each compound, the numbers counted in the five fields were added up, and the total was multiplied by the value of 10 $\mu m^2$/(the total area observed: 3.4 $\mu m^2 \times 5$), thereby calculating the number of particles per 10 $\mu m^2$.

Mg solid-solution ratio was determined as follows. A sample taken from the test specimen was observed by TEM at a magnification of 100,000. In randomly selected ten fields, the Mg concentration in the Cu matrix part having no precipitate was measured by EDX analysis. The average of the Mg concentrations measured in all the fields (in mass %) was defined as the amount of dissolved Mg of the sample, and the Mg solid-solution ratio was determined by the following equation (2).

$$\text{Mg solid-solution ratio (\%)} = \text{the amount of dissolved Mg (mass \%)} / \text{the total Mg content (mass \%)} \times 100 \quad (2)$$

Incidentally, the total Mg content was determined by a method in which the Mg content of a sample taken from the test specimen was measured by ICP atomic emission spectrometry.

Electrical conductivity was measured in accordance with JIS H0505. An electrical conductivity of 65% IACS or more was rated as acceptable.

0.2% offset yield strength was measured by a tensile test in LD in accordance with JIS Z2241. A 0.2% offset yield strength of 450 N/$mm^2$ or more was rated as acceptable.

With respect to bending workability, using a jig shown in JIS H3110, a W bending test was performed under conditions where the bending axis was LD (B.W.), and the ratio R/t between the bending radius R and the thickness t was 0.5. The bended part was observed under an optical microscope at a magnification of 50. Samples with no cracking observed were rated as O (good), and other samples were rated as x (poor).

Stress relaxation ratio was determined as follows. A long, thin specimen having a length of 100 mm in LD and a width of 0.5 mm in TD was cut from a test specimen having a thickness of 0.64 mm by wire cutting, and subjected to the cantilever stress relaxation test described in the Standard of Electronic Materials Manufacturers Association of Japan, EMAS-1011. In the test, the specimen was set with a load stress equivalent to 80% of the 0.2% offset yield strength being applied in such a manner that the direction of deflection displacement being imparted was TD, and held at 150° C. for 1,000 hours, and the resulting stress relaxation ratio was measured. The stress relaxation thus determined is defined as "stress relaxation with deflection direction TD." A stress relaxation with deflection direction TD of 35% or more was rated as acceptable. The results of examination are shown in Table 3.

TABLE 3

| | Precipitate | | Mg | |
|---|---|---|---|---|
| Example No. | Density of Fe—P-based Compound having Particle Size of 50 nm or More (the number of particles/10 $\mu m^2$) | Density of Mg—P-based Compound having Particle Size of 100 nm nm or More (the number of particles/10 $\mu m^2$) | Total Mg Content a (mass %) | Dissolved Mg Amount based on EDX Measurement b (mass %) |
| Example 1 | 1.8 | 3 | 0.14 | 0.13 |
| Example 2 | 0.6 | 4.1 | 0.18 | 0.13 |
| Example 3 | 0.6 | 1.2 | 0.04 | 0.021 |
| Example 4 | 8.9 | 8.9 | 0.82 | 0.60 |
| Example 5 | 1.2 | 1.2 | 0.03 | 0.016 |
| Example 6 | 1.2 | 1.2 | 0.18 | 0.15 |
| Example 7 | 0.6 | 2.4 | 0.16 | 0.13 |
| Comparative Example 1 | 4.7 | 11.3 | 0.14 | 0.05 |
| Comparative Example 2 | 14.2 | 8.9 | 0.14 | 0.09 |
| Comparative Example 3 | 10.7 | 6.5 | 0.14 | 0.09 |

TABLE 3-continued

| | | | | |
|---|---|---|---|---|
| Comparative Example 4 | 10.7 | 11.8 | 0.14 | 0.06 |
| Comparative Example 5 | 11.3 | 9.5 | 0.14 | 0.09 |
| Comparative Example 6 | 12.4 | 11.3 | 0.14 | 0.03 |
| Comparative Example 7 | 10.7 | 4.1 | 0.14 | 0.12 |
| Comparative Example 8 | 0.6 | 10.7 | 0.14 | 0.06 |
| Comparative Example 9 | 0 | 10.7 | 0.14 | 0.13 |
| Comparative Example 10 | 12.4 | 1.2 | 0.04 | 0.03 |
| Comparative Example 11 | 3.6 | 2.4 | 0.02 | 0.013 |
| Comparative Example 12 | — | — | 1.10 | — |
| Comparative Example 13 | 2.4 | 3 | 0.14 | 0.13 |
| Comparative Example 14 | 0.6 | 0.6 | 0.13 | 0.12 |
| Comparative Example 15 | 2.4 | 4.1 | 0.15 | 0.12 |

| | | Properties | | | |
|---|---|---|---|---|---|
| Example No. | Mg Mg Solid-Solution Ratio b/a × 100 (%) | Electrical Conductivity (% IACS) | 0.2% Offset Yield Strength LD ($N/mm^2$) | Bending Workability 90° W Bending B.W. R/t = 0.5 | Stress Relaxation Deflection Direction: TD 150° C. × 1000 h (%) |
| Example 1 | 92.9 | 76 | 502 | ○ | 19 |
| Example 2 | 72.2 | 73 | 489 | ○ | 21 |
| Example 3 | 52.5 | 67 | 473 | ○ | 33 |
| Example 4 | 73.2 | 65 | 472 | ○ | 15 |
| Example 5 | 53.3 | 78 | 465 | ○ | 26 |
| Example 6 | 83.3 | 71 | 489 | ○ | 23 |
| Example 7 | 81.3 | 70 | 524 | ○ | 17 |
| Comparative Example 1 | 35.7 | 78 | 515 | X | 46 |
| Comparative Example 2 | 64.3 | 74 | 473 | ○ | 40 |
| Comparative Example 3 | 64.3 | 77 | 496 | ○ | 42 |
| Comparative Example 4 | 42.9 | 78 | 781 | X | 40 |
| Comparative Example 5 | 64.3 | 78 | 476 | ○ | 38 |
| Comparative Example 6 | 21.4 | 78 | 442 | X | 41 |
| Comparative Example 7 | 85.7 | 76 | 529 | X | 38 |
| Comparative Example 8 | 42.9 | 58 | 457 | X | 52 |
| Comparative Example 9 | 92.9 | 77 | 424 | ○ | 41 |
| Comparative Example 10 | 75.0 | 58 | 479 | ○ | 28 |
| Comparative Example 11 | 65.0 | 78 | 491 | ○ | 39 |
| Comparative Example 12 | — | — | — | — | — |
| Comparative Example 13 | 92.9 | 49 | 541 | ○ | 16 |
| Comparative Example 14 | 92.3 | 53 | 531 | ○ | 15 |
| Comparative Example 15 | 80.0 | 59 | 494 | ○ | 22 |

Underline: Outside the specified range according to the present invention

As is clear from Table 3, the copper alloy sheet materials of Examples 1 to 7 according to the present invention have excellent properties in terms of all of electrical conductivity, strength (0.2% offset yield strength), bending workability, and stress relaxation resistance with deflection direction TD.

The following Comparative Examples 1 to 8 are examples in which the chemical composition was appropriate, but the production conditions were inappropriate.

In Comparative Example 1, the final pass temperature in hot rolling was too low. Accordingly, a large amount of coarse Mg—P-based compound was present in the obtained hot-rolled plate, and the structure condition could not be normalized in the subsequent steps. As a result, the bending workability and the stress relaxation resistance with deflection direction TD were poor.

In Comparative Example 2, the final pass temperature in hot rolling was too high. Accordingly, a large amount of coarse Fe—P-based compound was produced in the high-temperature stage after the final pass, and a fine Fe—P-based compound could not be sufficiently produced in the subsequent steps. As a result, the stress relaxation resistance with deflection direction TD was poor.

In Comparative Example 3, the first intermediate annealing was omitted. Accordingly, a fine Fe—P-based compound could not be preferentially produced. As a result, the stress relaxation resistance with deflection direction TD was poor.

In Comparative Example 4, the temperature rise rate in the first intermediate annealing was low, and also the holding temperature was low. Accordingly, a large amount of coarse Mg—P-based compound was produced, and the bending workability was poor. In addition, the amount of fine Fe—P-based compound and the Mg solid-solution ratio were insufficient, resulting in poor stress relaxation resistance with deflection direction TD.

In Comparative Example 5, the cooling rate in the first intermediate annealing was low. Accordingly, the preferentially precipitated fine Fe—P-based compound was coarsened during the cooling process. As a result, the stress relaxation resistance with deflection direction TD was poor.

In Comparative Example 6, the cooling rate after solidification in casting was low, thus large amounts of extremely coarse Fe—P-based compound and Mg—P-based compound were produced in the slab, and the temperature of the subsequent slab heating was also low. Accordingly, a structure having fine precipitates dispersed therein was not finally obtained. As a result, the bending workability and the stress relaxation resistance with deflection direction TD were poor.

In Comparative Example 7, the cold rolling ratio was low. Accordingly, an Fe—P-based compound was not sufficiently produced by the short-time heating in the first intermediate annealing, and the subsequent second intermediate annealing was performed at a higher temperature to produce an Fe—P-based compound. However, because the processing rate before annealing was low, recrystallization was insufficient. Further, because the second intermediate annealing temperature was high, the Fe—P-based compound grew, causing a decrease in bending workability. In addition, as a result of the insufficient distribution of fine precipitates, the stress relaxation resistance with deflection direction TD was also poor.

In Comparative Example 8, the temperature of the second intermediate annealing was too low. Accordingly, recrystallization was insufficient, resulting in inferior electrical conductivity. In addition, in the second intermediate annealing, the precipitation and growth of an Mg—P-based compound were predominant over the precipitation of an Fe—P-based compound, resulting in poor bending workability and poor stress relaxation resistance with deflection direction TD.

The following Comparative Examples 9 to 15 are examples in which the chemical composition is outside the specified ranges of the present invention.

In Comparative Example 9, Fe and P were insufficient. Therefore, the strength-improving function and the improving function on stress relaxation resistance of a fine Fe—P-based compound were not exerted.

In Comparative Example 10, Fe was excessive. Therefore, the electrical conductivity was inferior.

In Comparative Example 11, Mg is slightly lower than the specified range of the present invention. In this case, the absolute amount of dissolved Mg was insufficient, making it impossible to achieve the strict goal of stress relaxation resistance, that is, a stress relaxation with deflection direction TD of 35% or less.

In Comparative Example 12, Mg and P were excessive. Therefore, a large amount of extremely coarse Mg—P-based compound was produced in the casting step. As a result, hot tearing occurred, and thus the following steps were canceled.

In Comparative Examples 13, 14, and 15, Sn, Ni, and Zn were excessive, respectively, all resulting in inferior electrical conductivity.

The invention claimed is:

1. A copper alloy sheet material comprising, in mass %, Fe: 0.05 to 2.50%, Mg: 0.03 to 1.00%, P: 0.01 to 0.20%, Sn: 0 to 0.50%, Ni: 0 to 0.30%, Zn: 0 to 0.30%, Si: 0 to 0.04%, Co: 0 to 0.10%, Cr: 0 to 0.10%, B: 0 to 0.10%, Zr: 0 to 0.10%, Ti: 0 to 0.10%, Mn: 0 to 0.10%, and V: 0 to 0.10%, the balance being Cu and inevitable impurities, and having a chemical composition that satisfies the following equation (1), the copper alloy sheet material being such that when the average Mg concentration (mass %) in a Cu matrix part determined by EDX analysis through TEM observation at a magnification of 100,000 is defined as the amount of dissolved Mg, the Mg solid-solution ratio defined by the following equation (2) is 50% or more, the density of an Fe—P-based compound, which is observed by TEM at a magnification of 40,000 and is identified by an EDX spectrum having Fe ad P peaks, having a particle size of 50 nm or more is 10.00 particles/10 $\mu m^2$ or less, and the density of an Mg—P-based compound, which is observed by TEM at a magnification of 40,000 and is identified by an EDX spectrum having Mg and P peaks, having a particle size of 100 nm or more is 10.00 particles/10 $\mu m^2$ or less:

$$Mg-1.18(P—Fe/3.6)\geq 0.03 \ldots \quad (1)$$

$$\text{Mg solid-solution ratio (\%)}=\text{the amount of dissolved Mg (mass \%)/the total Mg content (mass \%)}\times 100 \ldots \quad (2),$$

wherein the element symbols Mg, P, and Fe in the equation (1) are substituted with the contents of the respective elements in mass %.

2. The copper alloy sheet material according to claim 1, having the following properties:

an electrical conductivity of 65% IACS or more;

when the rolling direction is defined as LD, and the direction perpendicular to both the rolling direction and the thickness direction is defined as TD, a 0.2% offset yield strength in LD of 450 $N/mm^2$ or more in accordance with JIS Z2241;

bending workability such that no cracking is observed in a W bending test in accordance with JIS Z3110 under conditions where the bending axis is LD and the ratio R/t between the bending radius R and the thickness t is 0.5; and a stress relaxation ratio of 35% or less in the case where, in a cantilever stress relaxation test using a specimen whose longitudinal direction agrees with LD and width in TD is 0.5 mm, a load stress of 80% of the 0.2% offset yield strength in LD is applied to the specimen in such a manner that the direction of deflection displacement being imparted is TD, followed by holding at 150° C. for 1,000 hours.

3. An electric current-carrying component obtained by processing the copper alloy sheet material of claim 1, for use under load stress applied in a direction in the component derived from the direction (TD) perpendicular to both the rolling direction and the thickness direction of the copper ahoy sheet material.

* * * * *